US005316389A

United States Patent [19]

Hoffman

[11] Patent Number: 5,316,389

[45] Date of Patent: May 31, 1994

[54] DRAWER SLIDE ASSEMBLY

[75] Inventor: Keigh A. Hoffman, Hudsonville, Mich.

[73] Assignee: Knape & Vogt Manufacturing Company, Grand Rapids, Mich.

[21] Appl. No.: 934,423

[22] Filed: Aug. 24, 1992

[51] Int. Cl.[5] ..... F16C 29/04

[52] U.S. Cl. ..... 384/18; 384/21

[58] Field of Search ..... 384/18, 21, 49, 19, 384/34, 22

[56] References Cited

U.S. PATENT DOCUMENTS

| | | | |
|---|---|---|---|
| 2,277,702 | 3/1942 | Kennedy | 45/77 |
| 2,277,703 | 3/1942 | Kennedy | 45/77 |
| 2,859,070 | 11/1958 | Gomersall . | |
| 2,981,584 | 4/1961 | Friend | 312/337 |
| 3,092,429 | 6/1963 | Barnes | 312/333 |
| 3,123,419 | 3/1964 | Maxwell | 312/333 |
| 3,141,714 | 7/1964 | Valitus | 312/348 |
| 3,142,517 | 7/1964 | Ward . | |
| 3,243,247 | 3/1966 | Knape | 312/333 |
| 3,259,447 | 7/1966 | Deutsch | 312/348 |
| 3,278,250 | 10/1966 | Vogt | 312/339 |
| 3,589,778 | 6/1971 | Olson . | |
| 3,782,800 | 1/1974 | Remington | 312/333 |
| 3,937,531 | 2/1976 | Hagen . | |
| 3,954,315 | 5/1976 | Sanden | 312/333 |
| 3,995,927 | 12/1976 | Stein | 312/333 |
| 4,065,196 | 12/1977 | Stein | 312/333 |
| 4,274,689 | 6/1981 | VanderLey | 312/333 |
| 4,423,914 | 1/1984 | VanderLey | 312/333 |
| 4,441,772 | 4/1984 | Fielding | 312/330 |
| 4,473,262 | 9/1984 | Staye | 312/333 |
| 4,560,212 | 12/1985 | Papp . | |
| 4,662,761 | 5/1987 | Hoffman | 384/18 |
| 4,765,669 | 8/1988 | Bessinger | 312/339 |
| 4,998,828 | 3/1991 | Hobbs | 384/18 |
| 5,085,523 | 2/1992 | Hobbs | 384/21 |
| 5,255,983 | 10/1993 | Parvin | 384/21 |

*Primary Examiner*—Lenard A. Footland

*Attorney, Agent, or Firm*—Price, Heneveld, Cooper, DeWitt & Litton

[57] ABSTRACT

A drawer slide stop lever mechanism comprises a stop lever that is fixed to an inner channel member between the ends of the channel, and at one end of the stop lever, with the other end being free to resiliently flex from an at rest position to an actuated position. This stop lever includes a lever trigger, and a middle portion having a block with stop faces. Corresponding to the stop faces are faces found on opposing stop means of the other intermediate rail.

17 Claims, 7 Drawing Sheets

DRAWER SLIDE ASSEMBLY

FIELD OF THE INVENTION

The present invention relates to drawer slides, more specifically, stop assemblies in drawer slides.

BACKGROUND OF THE INVENTION

Drawer slides are necessary components in the manufacture of quality cabinets and furniture of various kinds. Some of the more demanding applications are found in the office furniture industry where the drawer slide function must satisfy the customers of the office furniture manufacturer.

The most fundamental purpose of the drawer slide is to provide smooth and effortless movement of a drawer to which it is attached, from a closed position to an open position. Sometimes this is accomplished by two channel members that slide in relation to each other, either by means of a roller or by means of ball bearing support. With respect to the present invention, it is the stop function of the drawer slide, that is the means by which the drawer slide is made to stop at the end of its desired travel, and the ability to override the stop mechanism for drawer removable, that is the primary subject herein.

Stop lever assemblies are known that allow for competent stopping of the drawer at the end of its travel while providing convenient means for removal of the drawer once the stop is overcome. One such stop lever assembly utilizes a lever that is interior to the channel member that is affixed to the drawer to disengage a drawer from the slide assemblies. Normally, a central raised portion of the lever is able to contact a corresponding stop found on the opposing channel member. Thus, as the drawer is opened, it travels unimpeded until the stop lever engages the stop, thereafter preventing any further forward travel. In order to remove the drawer, it is necessary for the user to actuate a tab that extends from the stop lever into a position where it clears the stop. After accomplishing this, the drawer with attached channels is free to be removed from the cabinet. One lever or one side is raised and the second lever of the second side is lowered A subsequent improvement enabled the levers on both sides to be raised. However, these are ergonomically difficult to operate and they tend to stick and jam.

Another type of stop lever utilizes an action that works in the same direction of travel as the drawer and the slide. The tab extends forward from the area of the stop and has a loop in the end for the user to engage. Once the loop is pulled forward for the desired distance, the stop is overcome and the drawer and channel can be removed from the cabinet. Other stop levers are known in the drawer slide industry, but they typically share much of the above-described approaches.

The space allowed for stop lever mechanisms within the inner channel is extremely limited, since the entire rail assembly is only a short one-half inch in width. Thus, the usage of a mechanism is usually severely constrained by the design of the channel. At least in the vertical directions, the throw that a given tab or lever may have is determined by the clearance allowed within the inner channel. The lever that utilizes the line of travel action has a longer throw but requires the user to affirmatively engage the loop and pull it sufficiently forward. This action is clumsy and awkward and not as easy for everyone to accomplish as the vertical action.

It would be convenient to be able to simply push a stop release lever inwardly-laterally towards the drawer walls when releasing the slide But the tiny clearance between the rails has, as far as is known, prevented an effective release of this type.

Another difficulty with present mechanisms involves the movable stop lever block face that is in abuttable alignment with an opposing fixed stop block face. These block faces are substantially perpendicular to the line of travel of the slide mechanism. This construction is known to fail its purpose as an end stop at times, when the user opens the drawer faster than normal. What appears to happen is a reactive flexing or rebounding of the stop lever mechanism that allows the stop block face to be overcome and the drawer and the inner channel member then pulled completely and unexpectedly out the drawer slide assembly. This unexpected event can cause damage or injury since the user is not normally aware that it is going to happen.

SUMMARY OF THE INVENTION

It is an object of the present invention to provide a stop lever mechanism that is efficient in stopping the forward travel of a drawer while at the same time is extremely convenient for a user to access and actuate. The levers on opposite sides can actually be laterally flexed inwardly toward the drawer in a comfortable fashion.

It is also an object of the present invention to provide a stop lever mechanism that operates ergonomically within the extremely narrow envelope defined by the width of the inner channel member.

It is also an object of the present invention to provide a stop lever mechanism that assuredly affirmatively engages the stop on the corresponding channel member.

These and other objects of the present invention will be discussed in detail below and be apparent from the detailed description including the drawings.

The new stop lever mechanism comprises a stop lever that is fixed to an inner channel member between the ends of the channel, and at one end of the stop lever, with the other end being free to resiliently flex from an at rest position to an actuated position. This stop lever includes a lever trigger, and a middle portion having a block with stop faces. Corresponding to the stop faces are faces found on opposing stop means of the other intermediate rail.

Oriented in lateral alignment with the lever trigger is a lever opening in the inner rail, that compatibly receives the lever tab as it is depressed into the opening. This opening does not necessarily have to be employed with a trigger that has a bridge forming configuration. The stop lever assembly of the present invention allows the lever trigger to be actuated by simply depressing it in a lateral direction to thereby disengage the stops.

Another feature of the present invention is the affirmative angular engagement means provided by the stop lever block face and the opposing stop block face. Both the stop lever block face and the stop block face are oriented at acute angles arranged in direct alignment when the drawer and inner channel member are advanced to the most forward position. The faces engage at the most forward position and lock-up the two opposing parts.

DESCRIPTION OF THE PREFERRED EMBODIMENTS

Figure 1:
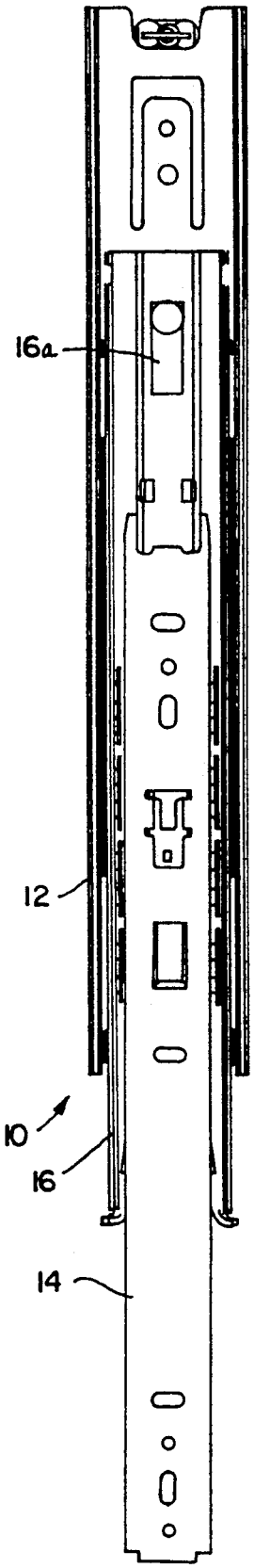
FIG. 1 is a side-elevational view of a partially extended drawer slide employing the present invention.

Referring now to the drawings, the drawer rail assembly 10 in the illustrative form of the invention set forth is shown to include an outer rail or channel 12, an intermediate rail or channel 16, and an inner rail or channel 14. The terms rail and channel are typically used in the trade interchangeably. In the illustrated embodiments of the invention, the slide assemblies, or simply "slides" as they are more commonly called, are arranged with their elongated axis horizontal, their smaller dimension being oriented vertically, and the thickness thereof being horizontal laterally. Typically, two such slide assemblies are employed, one on each side of a drawer or file, these being identical to each other except being in mirror image. For convenience, only one such slide assembly will be described in detail. In this description, the terms "vertical", "horizontal", "lateral", "above", "below", etc. are employed because of the particular orientation of the components as illustrated and as most commonly used. It will be realized, however, that the slides can be employed in pairs one above the other and spaced therefrom such that the vertical dimension in FIG. 2, for example, will then be horizontal. Therefore, these relative directional terms are set forth for convenience and are not intended to be limiting of the particular orientation of the invented slide assembly.

The rails are of generally C-shaped cross section as is commonly done. That is, outer rail 12 has a main vertical mounting panel or leg **12*a*, an upper generally horizontally extending leg 12*b*, and a lower generally horizontally extending leg 12*c*. In legs 12*b* and 12*c* are arcuate radiused concave ball bearing receiving races or tracks 22 and 22' to receive the ball bearings 18 and 18' of the outer, lower and upper bearings These ball bearings are in a series, axially spaced from each other by the retainers 20 and 20'. Preferably, the upper and lower legs 12*b* and 12*c* also extend beyond the usual termination points 42*b* and 42*c* to include abuttment extensions 50 and 50' each composed of intermediate sections 52 and 52' which are at an obtuse angle to the end of the arcuate portion, and terminal portions 54 and 54' which are at an obtuse angle to the intermediate sections 52 and 52'**. The details and advantages of this particular configuration are set forth in co-pending application Ser. No.932,718 filed Aug. 20, 1992 and entitled PRECISION DRAWER SLIDE MEMBER.

Intermediate rail 16 also includes a main vertically oriented panel or leg **16*a*, an upper generally horizontally extending leg 16*b*, and a lower generally horizontally extending leg 16*c*. Legs 16*b* and 16*c* have concave, radiused outer bearing tracks or races 24 and 24' on the lower and upper ends of the rail, respectively, and inner concave, radiused longitudinally extending tracks or races 32 and 32' on the lower and upper interfaces of legs 16*b* and 16*c*. These inner tracks receive inner, upper and lower bearings 28' and 28 which are secured in position by a single retainer 30** that extends between the two series of ball bearings.

Inner track 14 has a generally vertically oriented mounting leg or panel **14*a* with a lower leg 14*c* extending generally transversely therefrom in a generally horizontal orientation, and an upper leg 14*b* doing likewise. The outer surfaces of these two legs define elongated, radiused, arcuate ball tracks or races 34 and 34' to engage the ball bearings 28 and 28'** also. The inner rail has its generally C-shaped orientation opposite to the C-shaped orientation of the intermediate and outer rails. Typically, the outer rail will be mounted to a cabinet of some type and the inner rails will be mounted to a drawer or file of some type. However, this particular arrangement can be reversed with the inner rail mounted to the cabinet and the outer rail mounted to the drawer or other member to move relative to the cabinet.

Figure 3:
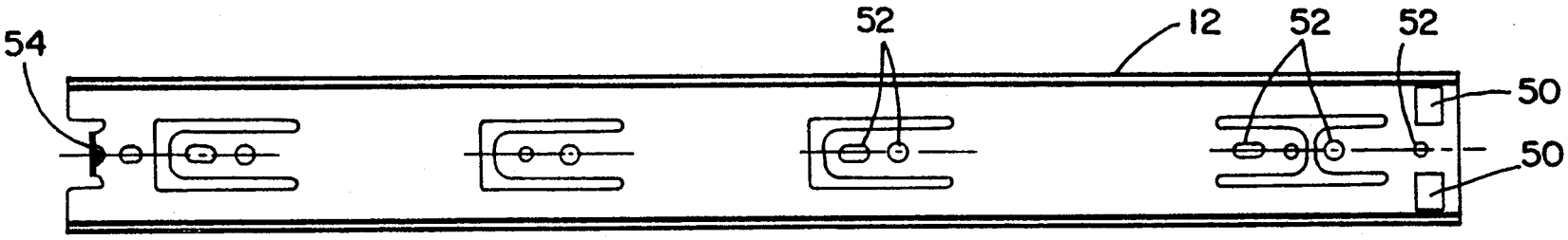
FIG. 3 is a side-elevational view of the outer rail of the assembly.
Figure 4:
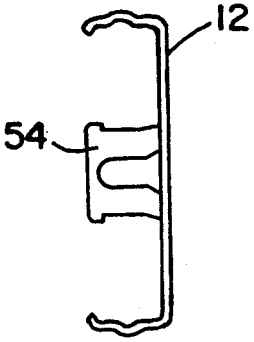
FIG. 4 is an end-elevational view of the rail in FIG. 3.
Figure 6:
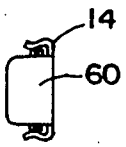
FIG. 6 is a end-elevational view of the rail in FIG. 5.

The outer rail 12, as shown in FIG. 3, includes at its forward, axially outer end, a pair of vertically spaced openings 50 to receive the snap-in protrusions or lugs of the cabinet stop to be described more fully hereinafter. It also includes along its length a plurality of mounting openings 52 at spaced intervals for attachment to the inner wall of a cabinet or the like. These openings are positioned such that even when the inner rail is to be mounted in the cabinet, and the intermediate rail and inner rail are assembled but is in extended condition, access can be had to the outer rail openings through openings **16*i* in the intermediate rail. At the inner end of the rail is a transversely extending vertically oriented tab or flange 54 which is received by the resilient inner cushion set forth in FIGS. 22–25** and to be described hereinafter. This resilient cushion is engaged by the inner stop end of the inner rail when the drawer slide is fully closed as will be described hereinafter.

The inner rail (FIGS. 5–9) 14 has an outer axial end flange 60 with a resilient backing material thereon for engagement with the center stop as a secondary safety stop as to be described hereinafter. Along the length of the inner rail 14 is a plurality of openings 64 for mounting the rail to a drawer. Also, openings are located at specific locations in the intermediate channel enabling access to the inner channel fastener when the slide assembly is either fully extended or fully retracted. Thus, access can be had by inserting a tool through openings e.g. **16*n* (FIG. 1**) and into engagement with the mounting screws or other fasteners used.

Figure 5:
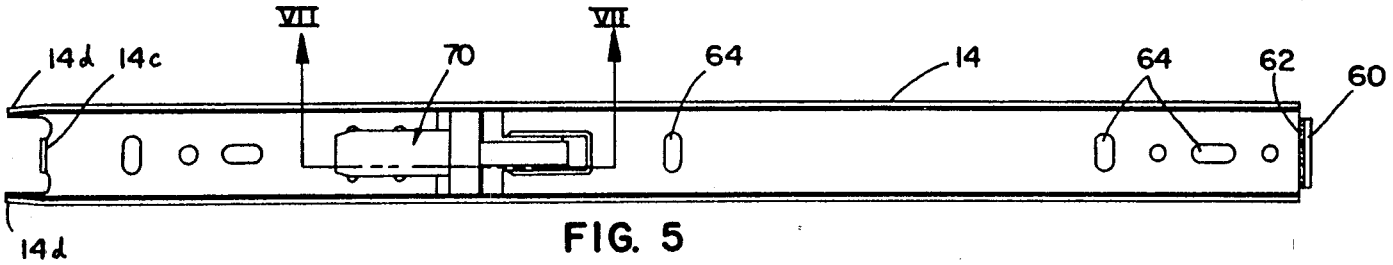
FIG. 5 is a side-elevational view of the outer face of the inner rail of the drawer slide assembly, including the stop lever.
Figure 7:
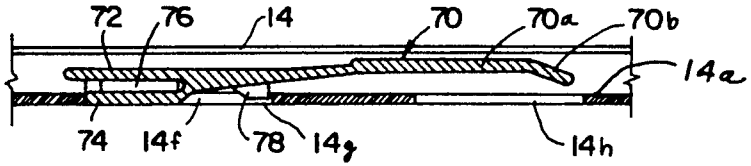
FIG. 7 is a cross-sectional enlarged view of the lever and rail in FIG. 5, taken on plane VII—VII.
Figure 8:
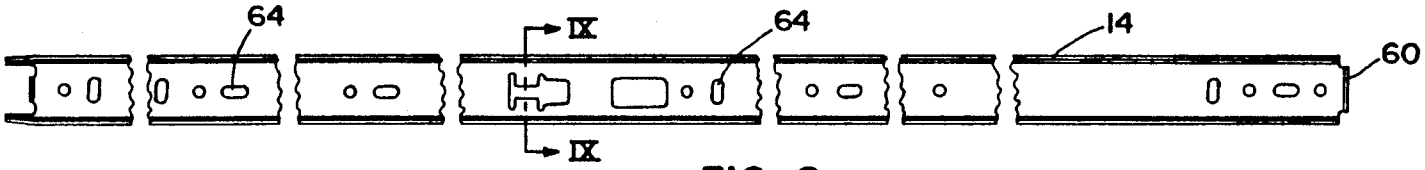
FIG. 8 is a side-elevational view of the inner rail without the stop lever.
Figure 9:
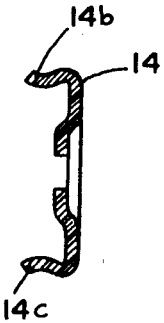
FIG. 9 is a cross-sectional view of the inner rail taken on plane IX—IX of FIG. 8.
Figure 11:
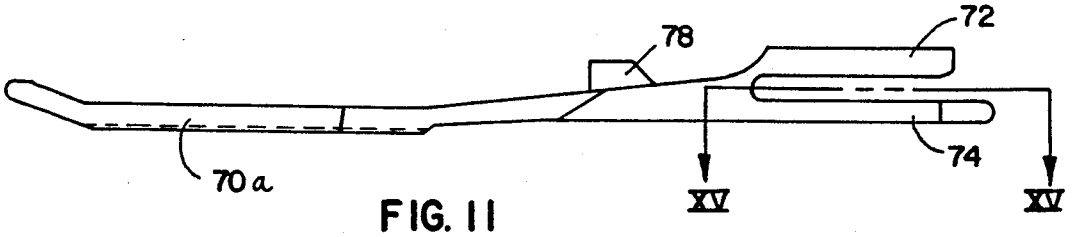
FIG. 11 is an enlarged side-elevational view of the stop lever.

At the inner end of inner rail 14 is a pair of flanges **14*b* (FIG. 5) which slope toward each other and which engage the opposite, lower, and upper convex vertical ends of the inner cushion 120 in FIGS. 22–25 in a manner to be described hereinafter, such that the interconnection formed holds the slide assembly closed until next activated. Adjacent these flanges, but spaced axially therefrom, is a stop tab 14*e* which strikes the front surface of the inner cushion when the assembly is closed, forming the first or primary stop. Intermediate the ends of inner rail is mounted the stop lever 70 (FIGS. 5 and 7). This stop lever is a polymeric, elongated element with its several portions being of one integral molded structure. It has a rear mounting end of a fork shaped configuration with one flange 72 thereof being an integral extension of the body of the element, and the other flange 74 being spaced from the first flange, parallel thereto, and defining a slot therebetween slidably to receive a mounting tang 76 offset from and integral with inner rail 14. Upon complete insertion of tang 76 into the slot, a laterally protruding retention abuttment 78 (FIG. 7) engages in a slot 14*f* behind the shoulder 14*g* of rail 14 to keep the stop lever in cooperative association mounted on inner rail 14 until it is to be purposely removed. Removal would be by depression of abuttment 78 to force it out of engagement with shoulder 14*g* and thereby allow the lever to be slid back out of its snapped in relationship with tang 76 of rail 14**.

Figure 12:
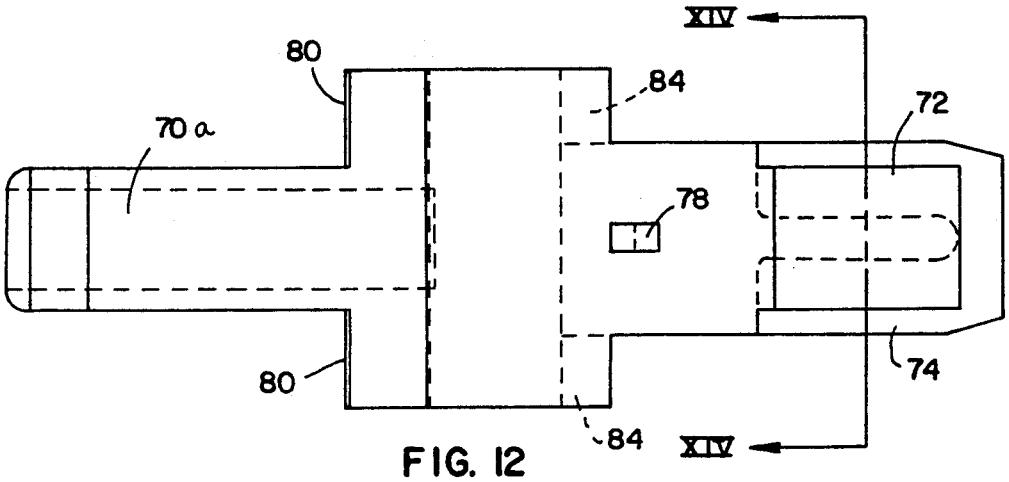
FIG. 12 is a plan view of the stop lever.
Figure 14:
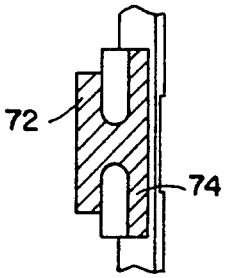
FIG. 14 is an enlarged fragmentary sectional view of the stop lever taken on plane XIV—XIV of FIG. 12.
Figure 13:
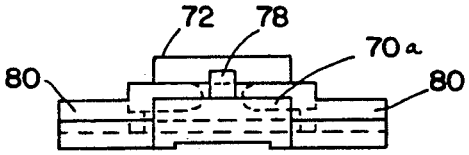
FIG. 13 is an end-elevational view of the stop lever.
Figure 15:
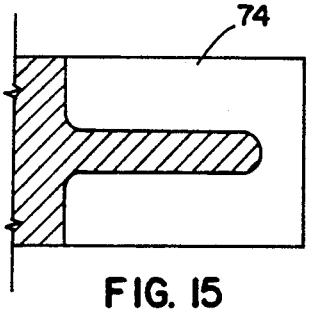
FIG. 15 is a fragmentary enlarged sectional view taken on plane XV—XV of FIG. 11.
Figure 10:
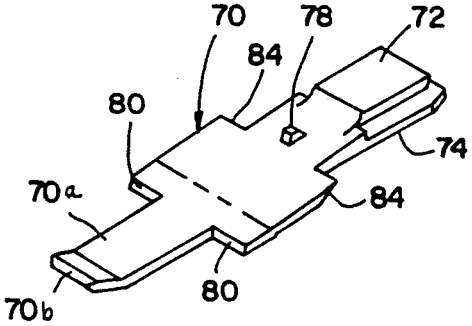
FIG. 10 is an isometric view of the stop lever.
Figure 17:
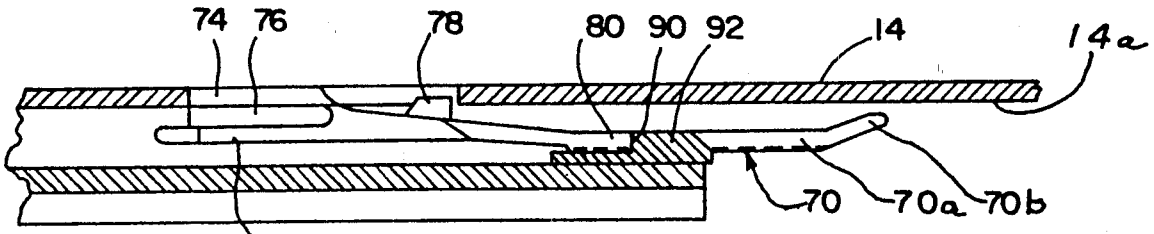
FIG. 17 is an enlarged, sectional, elevational fragmentary view of a portion of the assembly in FIG. 16 taken on the plane XVII—XVII.
Figure 18:
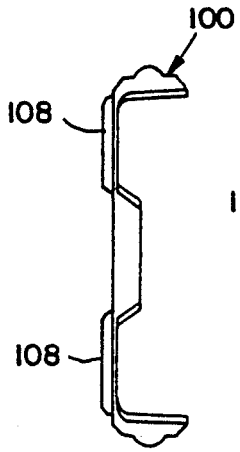
FIG. 18 is an end elevational view of the outer rail or cabinet stop of the assembly.
Figure 19:
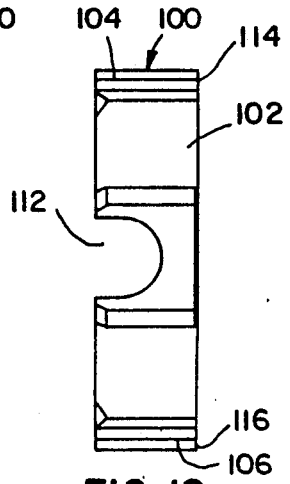
FIG. 19 is a side-elevational view of the outer rail or cabinet stop.

Rail 14 also preferably includes a window or opening **14*h* adjacent the terminal trigger portion 70*a* of lever 70 to provide more space for the trigger to be resiliently laterally depressed and thereby release the stop mechanism in a manner to be described. This trigger 70*a* also preferably includes a diagonally extending terminal or end portion 70*b* which is at an obtuse angle relative to portion 70*a* that generally is parallel to rail 14. End portion 70*b* therefore projects slightly toward the inner rail wall 14*a*, and toward window 14*h* if one is used. An alternative stop lever is shown in FIG. 17. In this instance, no window or opening comparable to 14*h* is provided in rail 14. This trigger 70*a* is of resilient polymeric material with end portion 70*b* being able to engage with the wall 14*a* of rail 14 so that, upon further deformation of the trigger, it will be in effect be in abuttment with rail 14 at both ends of the lever, like a bridge, such that further depression of the trigger will bias the abuttment stop shoulders 80 out of engagement with the cooperative shoulders 90 of center stop 92. This center stop 92 with its shoulders 90 is the same for both embodiments, i.e., whether or not window or opening 14*h* is present. The face of these shoulders 90 is preferably at an acute angle relative to a plane perpendicular to the long axis of the slide, preferably an angle of about 15°. This generally matches an acute angle of the face of abuttments 80 for a special binding, interacting stop feature which has been found particularly effective to prevent accidental release of the stop members if the two components are interengaged with too much force, i.e., with more force than normally expected, as by a rapid opening of the drawer. The stop shoulders 80 preferably are arranged as a pair of such shoulders astraddle the center of lever 70 as seen more specifically in FIGS. 10 and 12. The shoulders are at the small acute angle preferably of about 15° but conceivably between about 15° and about 45°, with the abuttment shoulders and the center stop being complementary thereto, i.e., also being about the same but opposite angle, so as to result in a binding action between the two surfaces when they engage, even if under considerable force. This has been shown by testing to produce a special locking action to prevent inadvertent release of the drawer rail components and thus of the drawer from the cabinet. Oriented toward the opposite end of the stop lever from the shoulders 80 is a pair of diagonal ramping surfaces 84 which cooperate with a similarly arranged pair of ramping shoulders 94 on lugs 90** for ease of assembly insertion of the inner rail into the intermediate rail. These ramp the stop lever with a temporary bias to allow passage of the stop surfaces.

Figure 20:
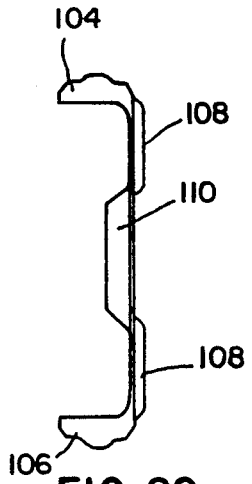
FIG. 20 is an end-elevational view of the opposite end of the outer rail or cabinet stop.
Figure 21:
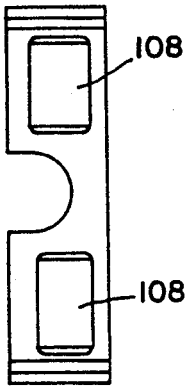
FIG. 21 is a back side-elevational view of the outer rail or cabinet stop.
Figure 23:
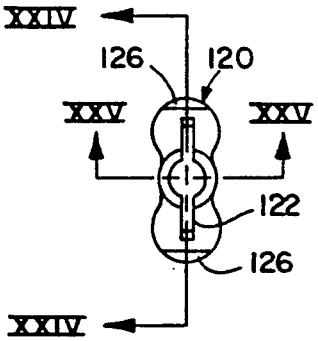
FIG. 23 is an end-elevational view of the outer cushion.
Figure 24:
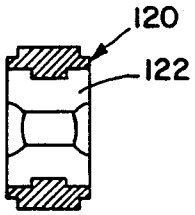
FIG. 24 is a sectional view of the inner end cushion taken on plane XXIV—XXIV of FIG. 3.
Figure 22:
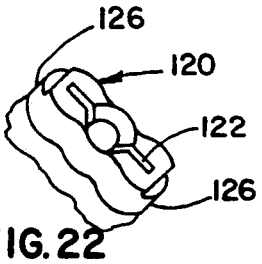
FIG. 22 is an isometric view of the outer cushion.
Figure 25:
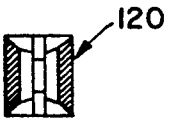
FIG. 25 is a sectional view of the cushion taken on plane XXV—XXV of FIG. 23.
Figure 30:
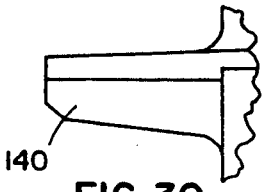
FIG. 30 is a fragmentary, greatly enlarged view of one of the bridging fingers on the center stop in FIGS. 26–29.
Figure 28:
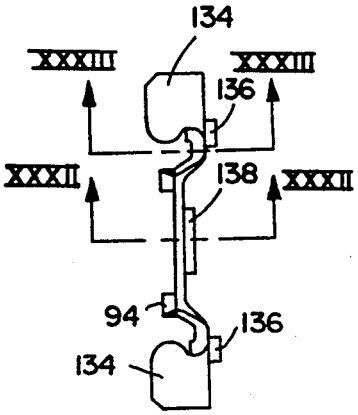
FIG. 28 is an end-elevational view of the outer end of the center stop.
Figure 27:
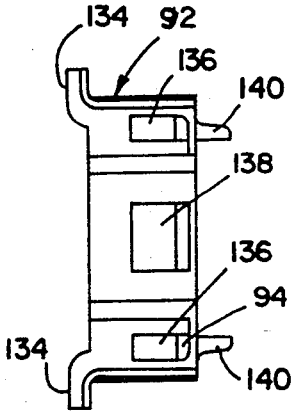
FIG. 27 is a side-elevational view of the outer face of the center stop.
Figure 29:
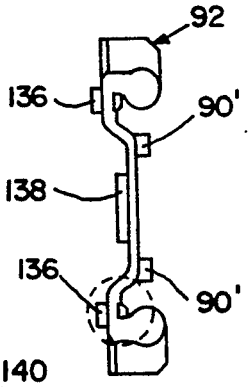
FIG. 29 is an end-elevational view of the inner end of the center stop.
Figure 26:
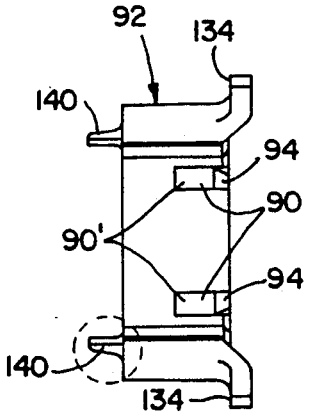
FIG. 26 is a side-elevational view of the inside face of the center stop.
Figure 31:
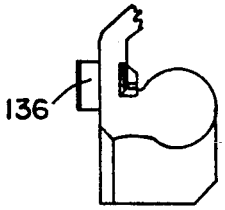
FIG. 31 is a greatly enlarged, end-elevational, fragmentary view of a portion of the center stop in the circle shown in FIG. 29.
Figure 33:
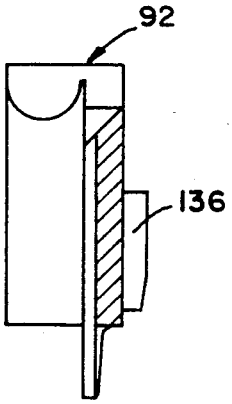
FIG. 33 is a sectional view taken on plane XXXIII—XXXIII in FIG. 28.
Figure 32:
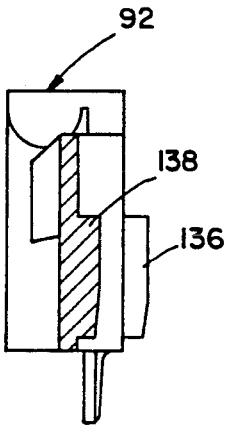
FIG. 32 is a sectional view of the center stop taken on plane XXXII—XXXII of FIG. 28.

Also formed of an integral polymeric molded structure is the cabinet or outer rail stop 100 (FIGS. 18–21). Cabinet stop 100 basically has a polymeric body extending the height of the outer rail, the body 102 having an upper transverse flange 104 and a lower transverse flange 106 which are positioned in the bearing races and against the upper and lower legs of the outer rail when assembled. The polymeric element is snap fitted into openings 50 (FIG. 3) of outer rail 12 with insertion of a pair of snap lugs 108 on the back face of body 102 (FIG. 21). In the central portion of the front face is a bearing protrusion 110 which engages the offset central portion **16*d* (FIG. 2) of the intermediate rail 16, whereas the inner parts of the body 102 astraddle this projection 110 form a bearing surface for the portions of intermediate rail 16 astraddle the offset 16*d*. Bearing protrusion 110 can have an orifice 112 therein matching an orifice 52**

(FIG. 3) in the outer rail for insertion of a fastener. The edges 114 and 116 of flanges 104 and 106 serve as stop elements which are engaged by a pair of outwardly extending wings 134 and 136 of the center stop 92 (FIGS. 26–31) to be described hereinafter, when the slide is closed or contracted.

Figure 16:
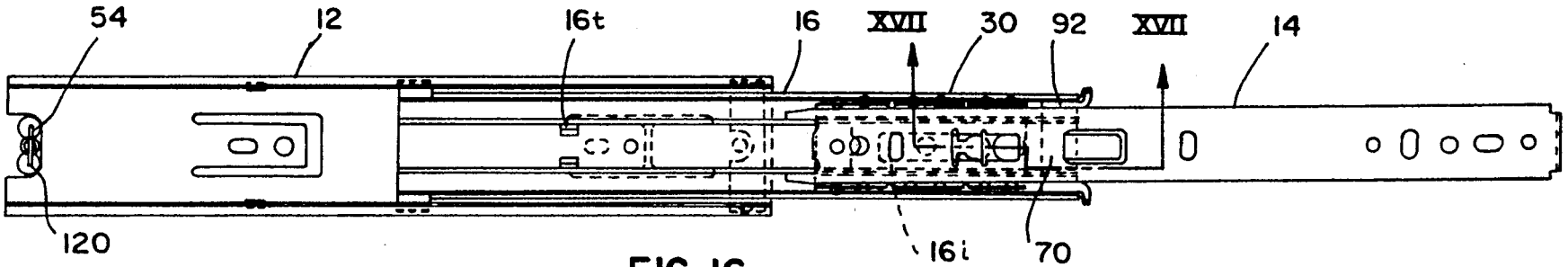
FIG. 16 is a side-elevational view of a drawer rail assembly of an embodiment with no window in the inner rail to receive the stop lever trigger.

In FIGS. 22–25 is shown the resilient inner cushion 120 which is mounted on transverse flange or tab 54 (FIG. 3) of outer rail 12 at the inner end of this outer rail. This stop element is shown to be shaped somewhat like a FIG. 8, being vertically positioned in the orientation of the rail assembly depicted, and having an elongated central vertical slot 122 for receiving flange 54 as depicted in FIG. 16. The upper and lower ends of cushion 120 are preferably convexly curved, with the overall height dimension of this cushion being slightly greater than cooperative vertical spacing between the two flanges **14*d* at the inner end of inner rail 14 (FIG. 5). Thus, when the inner rail is almost fully closed, and just before stop flange 14*e* on the inner rail engages the axial face of cushion 120, the straddling flanges 14*d* will engage and slightly resiliently deform the curved upper and lower surfaces 126 of stop cushion 120 to provide a smooth closing and to serve a holding function to retain the drawer slide in contracted condition until again purposely extended. When cushion 62 hits center stop 92, it will compress a small amount and then flange 14*c* will engage cushion 120. At that point, the position of rail 14 will be such that cushion 62 (FIG. 5) will be in contact with center stop 92 and also the face of protrusion 10 on element 100 (FIG. 20**).

Referring now to FIGS. 26–31, the center stop 92 is there depicted. As noted previously, this center stop has two stop shoulders 90 with diagonal inwardly oriented acute angle faces 90' on the inside face of the component 92. On the rear face are three protruding snap-in lugs or protrusions 136 and 138 which form a snap fit with corresponding openings at the outer end of the intermediate rail. On the outer end of element 92 is the pair of wings 134 serving as stop surfaces when engaging the outer end 114 of cabinet stop 100 (FIG. 19) when the intermediate rail is fully closed into the outer rail. This polymeric member also serves as a resilient bushing have lubricious properties, for preventing rail to rail metal contact of the inner rail to the intermediate rail if the slide assembly is torsionally twisted.

On the opposite inner end of element 92 is a pair of special tapered, resilient, projecting fingers 140 (FIGS. 26 and 30) integral with the element, spaced from and parallel to each other, and spaced from the outermost plane of element 92 to overlap the metallic bearing retainer 30 in a position of the retainer adjacent the center stop. By extending slightly over the edge of the bearing retainer, this is beneficial when the inner rail is inserted longitudinally into engagement with the intermediate rail. Specifically, the inner rail will be guided by the fingers over the bearing retainer to prevent the inner end of the inner rail from engaging the end of the bearing retainer so that the latter will not be axially shifted by the end of the inner rail to cause difficulty of assembly. Rather, the inner end of the inner rail slides over the fingers which, also help to retain the bearing retainer, and into engagement with the ball bearings themselves, for optimum interengagement insertion.

Figure 2:
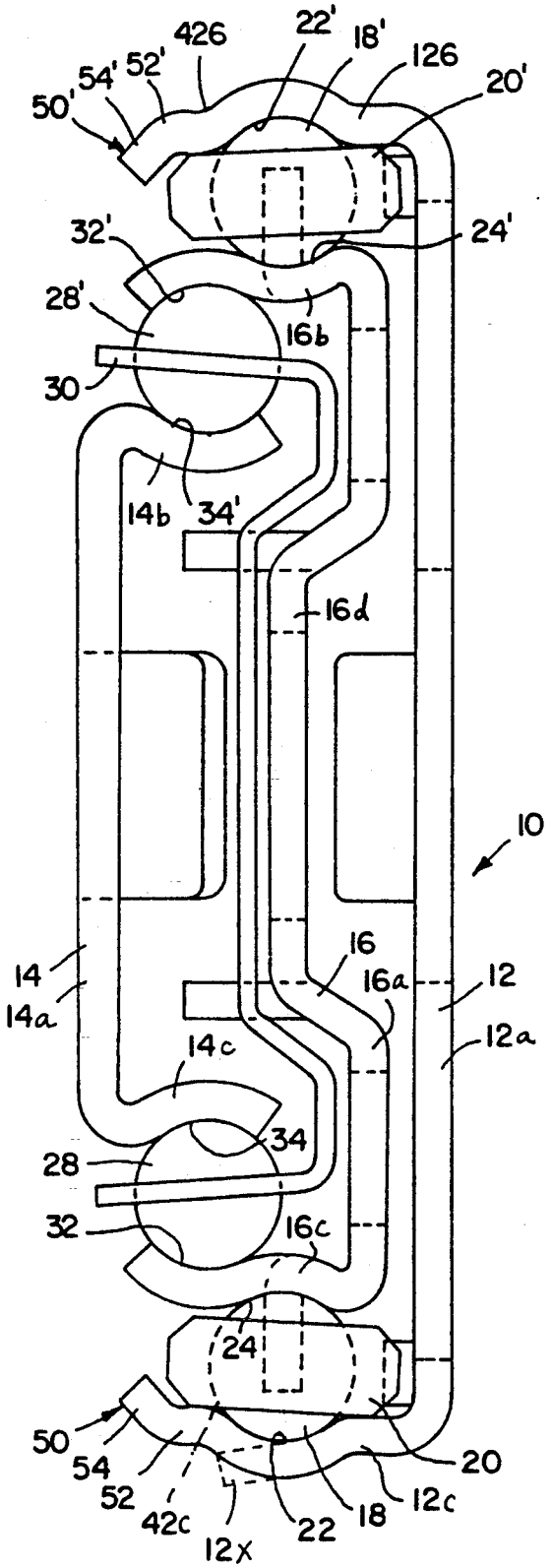
FIG. 2 is a cross-sectional view of the drawer slide in FIG. 1.

The inner end of element 92 also serves to limit actual movement of the outer axial end of the bearing retainer 30 (FIG. 2). The inner axial end of movement the bearing retainer 30 is limited by the collector or collectors tabs **16*t* (FIG. 16). These collectors 16*t* are specially located relative to the outer end of the intermediate rail such that optimum positioning of the rail members occurs with respect to each other. That is, these inner collector tabs are so located so that ball retainer 30 does not strike center stop 92 at full extension, under normal conditions. Because the retainer moves at one-half the speed and one-half the distance of the inner rail when extended, with proper placement of collector tabs 16*t*, that is, greater than the length of retainer 30 plus one-half of the travel distance of rail 14 relative to rail 16, the retainer will not normally strike but will stop closely adjacent to but short of center stop 92. If, however, stop lever 70 is actuated to receive rail 14 from slide assembly 10, movement of retainer 30 will be restrained by center stop 92**.

It will be realized that this entire assembly is composed of components that require no riveting, forming or staking of the metal, but rather, can be assembled or disassembled easily and quickly, even without tools. Thus, even if some of the components should become worn, for example, they can be readily removed and replaced, without tools, in a matter of seconds.

Another significant advantage of the assembly is that the components will not scrape, metal on metal, even under torsional loads, because the polymeric components which serve the functions of stops and guides, also form guide bushings between the slide elements. Further, the slide assembly can be mounted in a cabinet or the like and subsequently adjusted at full extension without removing the drawer. It has direct access openings or windows through the intermediate rail and the center member to allow an installer to insert the mounting screws into rail 14 without removing rail 14 from the slide assembly. The openings extend clear through the structure and all of its components for mounting when it is in contracted or closed condition.

The lead-in ramps on both the drawer, i.e., the inner rail and the outer cabinet rail allow for fast self-alignment when inserting the drawers. This is significant because the drawer is often inserted without being able to see the components interengaging.

Extensive testing has been conducted on this novel slide assembly. Such testing has shown that the unit has a wear life substantially longer than competitive units presently available either from the Assignee herein or its competitors. The structure operates accurately and smoothly, being readily assembled into a slide assembly with mere snap insertion of polymeric components and interleafing of the rails or channels. Moreover, the inner drawer rails when mounted on a drawer can be easily removed from the remaining components simply by flexing the two opposite triggers of the stop levers laterally inwardly toward the drawer walls in an ergonomically compatible fashion. Reinsertion of the drawer and the two drawer rails mounted thereto can be readily made into the remaining slide structure by simply pushing the rails telescopingly together. This action forces the ramping surfaces of the cooperating stop levers and stops into ramping relationship, resulting in movement of the stop levers past the stops into secured condition. The special acute angle relationship of the stop surfaces and the stop levers and stops assures stoppage even under abrupt drawer opening conditions.

It is entirely conceivable that those skilled in the art, once they review this disclosure, will think of various changes which can be made to adapt the unique slide structure to certain situations. Thus, the invention is not intended to be limited specifically to the preferred illustrative forms set forth herein but only by the scope of the appended claims and a reasonably equivalent structures by those defined therein.

The embodiments of the invention in which an exclusive property or privilege is claimed are defined as follows.

1. A drawer slide assembly comprising:

an elongated outer rail;

an elongated intermediate rail having an outer end;

an elongated inner rail having inner and outer ends;

a rail extension stop lever means between said inner rail and said intermediate rail for stopping extension of said inner rail relative to said intermediate rail;

said stop lever means comprising a polymeric lever element having one end attached to said inner rail, and a second trigger end extending along said inner rail spaced therefrom and resiliently shiftable toward said inner rail;

transversely oriented stop surfaces on said element; and a center stop on said intermediate rail outer end, said center stop having cooperative stop surfaces complementary to said stop lever element stop surfaces, for making a binding stop therewith upon extension of said slide assembly.

2. The drawer slide assembly of claim 1 wherein said stop surfaces being at an acute angle to a plane perpendicular to the long dimension of said inner rail and said cooperative stop surfaces are at an acute angle to a plane perpendicular to the long dimension of said intermediate rail.

3. The drawer slide assembly of claim 2 wherein said acute angles are in the range of about 15° to about 45°.

4. The drawer slide assembly of claim 1 wherein said inner rail has a mounting tang for said stop lever means, and said stop lever means one end comprises a fork defining a slot interfitting with said mounting tang.

5. The drawer slide assembly of claim 4 including a snap-in protrusion on said stop lever means, and an opening in said inner rail receiving said snap-in protrusion to help retain said stop lever means on said inner rail.

6. The drawer slide assembly of claim 1 wherein said trigger end has a terminal portion at an obtuse angle projecting towards an inner rail.

7. The drawer slide assembly of claim 1 wherein said inner rail has a window to receive said trigger end when the latter is resiliently biased for release of said stop surfaces to remove said inner rail from said intermediate rail.

8. The drawer slide assembly of claim 1 wherein said stop lever means has sloping ramping surface area and said center stop has cooperative aligned sloping ramping surface area enabling easy insertion of said inner rail into said intermediate rail by resiliently deflecting said stop surfaces of said stop lever means past said stop surfaces of said center stop.

9. A drawer slide assembly comprising:

an elongated outer rail having ball races and having an inner end and an outer end;

an elongated intermediate rail having ball races, an inner end and an outer end;

an inner rail having ball races, an inner end and an outer end;

first ball bearings in races between said outer rail and said intermediate rail;

second ball bearings in races between said intermediate rail and said inner rail;

an outer rail stop element at said outer end of said outer rail, comprising a lubricious polymeric element snap fitted into said outer rail;

said outer rail stop element extending between and into said ball races to serve as a lubricious bushing for said intermediate rail, and a retainer for said first ball bearings, as well as a stop for said intermediate rail;

a center stop element at said outer end of said intermediate rail, comprising a polymeric element snap fitted into said intermediate rail, and extending into said ball races of said intermediate rail to serve as a lubricious bushing for said inner rail, and a retainer for said second ball bearings, as well as a stop for said inner rail;

a stop lever means intermediate said ends of said inner rail for engaging said center stop element to serve as an extension stop for said inner rail relative to said intermediate rail; and said stop lever means comprising a polymeric element snap fitted into said inner rail.

10. The drawer rail assembly of claim 9 wherein said stop lever means has stop surfaces and said center stop has stop surfaces;

said stop lever means has a trigger end extending along said inner rail and resiliently shiftable laterally toward said inner rail;

transversely oriented stop surfaces on said element, said stop surfaces being at an acute angle to a plane perpendicular to the long dimension of said inner rail; and a center stop on said intermediate rail outer end, said center stop having cooperative stop surfaces at an acute angle to a plane perpendicular to the long dimension of said intermediate rail, and complementary to said stop lever element stop surfaces, for making a binding stop therewith upon extension of said slide assembly.

11. The drawer slide assembly of claim 10 wherein said acute angles are about 15°.

12. The drawer slide assembly of claim 10 wherein said acute angles are in the range of about 15° to about 45°.

13. A drawer slide assembly comprising:

an elongated outer rail having an inner end and an outer end;

an elongated intermediate rail having an inner end and an outer end;

an inner rail having an inner end and an outer end;

first bearings between said outer rail and said intermediate rail;

second bearings between said intermediate rail and said inner rail;

an outer rail stop element at said outer end of said outer rail, comprising a polymeric element snap fitted into said outer rail;

a center stop element at said outer end of said intermediate rail, comprising a polymeric element snap fitted into said intermediate rail; and a stop lever means intermediate said ends of said inner rail for engaging said center stop element to stop extension of said inner rail relative to said intermediate rail, said stop lever means comprising a polymeric element snap fitted into said inner rail.

14. The drawer slide assembly of claim 13 wherein said outer rail stop element, said center stop element and said stop lever means are removable without tools, for replacement thereof.

15. A drawer slide assembly comprising:

an elongated outer rail having ball races and having an inner end and an outer end;

an elongated intermediate rail having ball races, an inner end and an outer end;

an inner rail having ball races, an inner end and an outer end;

first ball bearings between said outer end intermediate rails in said races;

second ball bearings between said intermediate rail and said inner rail in said races;

a bearing retainer retaining said second ball bearings;

an outer rail stop element at said outer end of said outer rail, comprising a polymeric element;

a center stop element at said outer end of said intermediate rail, comprising a polymeric element fitted into said intermediate rail, and extending into said ball races of said intermediate rail;

a stop lever means intermediate said ends of said inner rail for engaging said center stop to serve as an extension stop for said inner rail relative to said intermediate rail;

said center stop having a pair of stop wings extending opposite to each other, beyond said intermediate rail ball races, and axially aligned with said outer rail stops to engage said outer rail stops upon full retraction of said slide assembly.

16. The drawer rail assembly of claim 15 wherein said center stop has guide fingers extending inwardly of said intermediate rail and spaced from said intermediate rail sufficiently to enable said fingers to overlap said bearing retainer for easy insertion of said inner rail to said intermediate rail without axially displacing said bearing retainer.

17. The drawer rail assembly of claim 16 wherein said stop lever means has sloping ramping surface area and said center stop has cooperative aligned sloping ramping surface area enabling easy insertion of said inner rail with said intermediate rail by resiliently deflecting said stop surfaces of said stop lever means past said stop surfaces of said center stop.

* * * * *

UNITED STATES PATENT AND TRADEMARK OFFICE

CERTIFICATE OF CORRECTION

PATENT NO. : 5,316,389

DATED : May 31, 1994

INVENTOR(S) : Keith A. Hoffman

It is certified that error appears in the above-indentified patent and that said Letters Patent is hereby corrected as shown below:

Cover Page
Applicant's Name should be -- Keith --;

Column 1, line 25;
"removable" should be -- removal --;

Column 1, line 44;
After "lowered" insert -- . --;

Column 2, line 3;
After "slide" insert -- . --;

Column 6, line 16;
After "it will" delete -- be --;

Column 7, line 11;
"FIG." should be -- figure --;

Column 9, line 3;
After "claims and" delete -- a --;

UNITED STATES PATENT AND TRADEMARK OFFICE

CERTIFICATE OF CORRECTION

PATENT NO. : 5,316,389

DATED : May 31, 1994

INVENTOR(S) : Keith A. Hoffman

It is certified that error appears in the above-indentified patent and that said Letters Patent is hereby corrected as shown below:

Column 9, line 4;
Delete "by" and substitute -- to --.

Signed and Sealed this

Fifteenth Day of August, 1995

Bruce Lehman

*Attest:*

BRUCE LEHMAN

*Attesting Officer*

*Commissioner of Patents and Trademarks*